US005660331A

United States Patent [19]

Cooke

[11] Patent Number: 5,660,331

[45] Date of Patent: Aug. 26, 1997

[54] FUEL SUPPLY SYSTEM

[75] Inventor: Michael Peter Cooke, Kent, England

[73] Assignee: Lucas Industries plc, Great Britain

[21] Appl. No.: 447,206

[22] Filed: May 22, 1995

[30] Foreign Application Priority Data

Jun. 7, 1994 [GB] United Kingdom ..... 9411345

[51] Int. Cl.[6] ..... B05B 9/00

[52] U.S. Cl. ..... 239/124; 239/533.9

[58] Field of Search ..... 239/533.3–533.5, 239/533.9, 96, 124–127, 585.1–585.5, 88–94, 582; 251/38, 39

[56] References Cited

U.S. PATENT DOCUMENTS 4,211,202 7/1980 Hafner ..... 123/457
5,531,382 7/1996 Buckley ..... 239/124

FOREIGN PATENT DOCUMENTS 0091373 3/1983 European Pat. Off. .
0647781 9/1994 European Pat. Off. .
0643221 9/1994 European Pat. Off. .
2182756 5/1987 United Kingdom .

*Primary Examiner*—Robert J. Oberleitner
*Assistant Examiner*—C. T. Bartz
*Attorney, Agent, or Firm*—Andrus, Sceales, Starke & Sawall

[57] ABSTRACT

An engine fuel system includes an accumulator chamber in which fuel is stored at high pressure and a three way valve having two settings in the first of which when a valve actuator is energised fuel flows from the accumulator chamber to a fuel injection nozzle and in the second of which when the actuator is de-energised fuel flows from the supply line of the nozzle to a drain. The valve includes a valve member directly coupled to the actuator and controlling the flow of fuel from the accumulator chamber to the nozzle, and a valve element which is resiliently coupled to the valve member and controls the flow of fuel from the line to the drain. The valve member and valve element cooperate with respective seatings and when the actuator is de-energised the valve element can move away from its seating against the action of the resilient coupling to allow a rapid reduction of fuel pressure in the line.

8 Claims, 1 Drawing Sheet

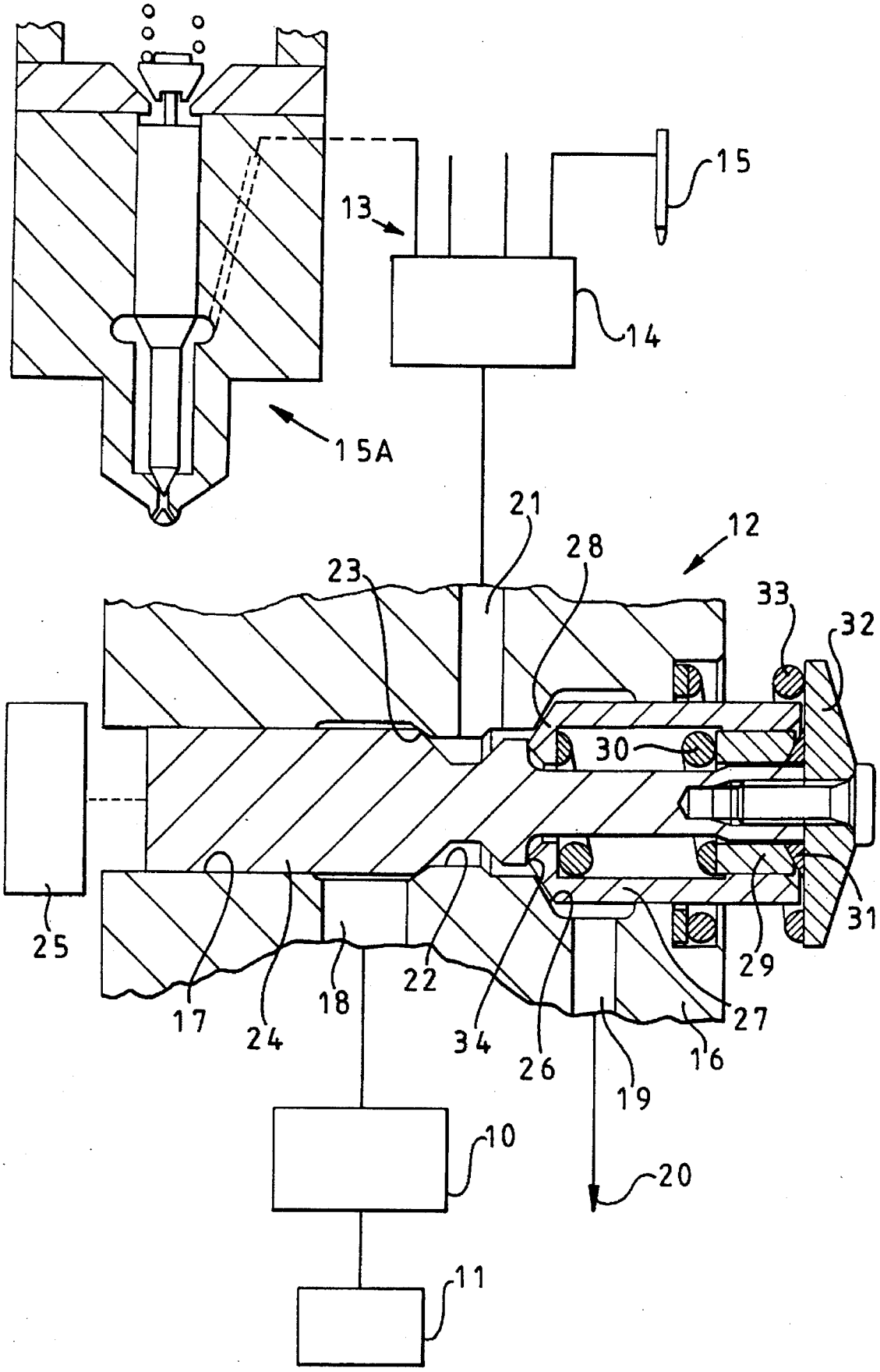
15
13
14
15A
21
12
28
23
33
32
30
25
31
29
17
24
18
22
34
26
27
16
19
10
20
11

FUEL SUPPLY SYSTEM

This invention relates to a fuel supply system for an engine, the system comprising a fuel injection nozzle including a valve member movable to an open position to allow fuel flow through an outlet from a nozzle inlet, an accumulator chamber for storing fuel under pressure and valve means operable to connect said nozzle inlet to the accumulator when it is required to supply fuel to the engine and to disconnect the inlet of the nozzle from the accumulator and to connect the inlet of the nozzle to a drain, when sufficient fuel has been supplied to the engine.

The object of the invention is to provide a fuel supply system of the kind specified in a simple and convenient form.

According to one aspect of the invention in a fuel system of the kind specified said valve means is a three way valve comprising a bore, first and second passages opening into the bore at axially spaced positions, said first passage being connected to the accumulator chamber and the second passage to the drain, a third passage connected to the nozzle inlet and opening into the bore, a first seating defined in the bore, an axially movable valve member slidable in the bore and shaped for cooperation with the first seating to control fuel flow between the first and third passages, means for moving the valve member into and out of sealing engagement with the first seating, a valve element movable into and out of sealing engagement with a second seating to control communication between the second and third passages, resilient means interconnecting the valve member and valve element whereby when the valve member is in engagement with the first seating the valve element will be spaced from the second seating, the fuel pressure in said third passage acting on said valve element in opposition to said resilient means to increase said spacing to facilitate fuel flow between said third passage and the second passage.

According to another aspect of the invention in a fuel supply system of the kind specified said valve means comprises a valve member slidable within a bore, first and second passages opening into the bore at axially spaced positions, said first and second passages being connected to the accumulator chamber and the drain respectively, a third passage opening into the bore at a position intermediate said first and second passages, said third passage being connected to the inlet of the nozzle, a first seating defined in the bore intermediate the first and third passages, a second seating defined in the bore intermediate the second and third passages, said valve member being shaped for engagement with the first seating, a valve element slidably mounted about the valve member, said valve element being engagable with the second seating, means biasing said valve element into engagement with a stop surface defined on said valve member whereby when said valve member is in engagement with the first seating there will be a clearance between the valve element and the second seating and means for moving the valve member axially.

An example of a fuel supply system in accordance with the invention will now be described with reference to the accompanying drawing which shows part of the system in sectional side elevation and the remaining portion of the system in outline only.

With reference to the drawing the fuel supply system comprises an accumulator chamber 10 in which fuel is stored at high pressure. Fuel is supplied to the accumulator chamber by means of a high pressure pump 11. Fuel is allowed to flow out of the accumulator chamber under the control of the valve means generally indicated at 12 and in the particular example, the fuel is distributed in turn to a plurality of outlets 13 by means of a rotary distributor member 14 which is driven in timed relationship with the associated engine. The outlets are connected to the fuel injection nozzles 15 respectively of the associated engine each of which as shown at 15A has a fuel pressure actuated valve member movable when the fuel pressure supplied to the nozzle attains a predetermined value, against the action of a spring to allow fuel flow through a nozzle outlet from the nozzle inlet. Conveniently the high pressure pump 11 includes a pair of plungers which are mounted in the distributor member 14, the plungers being actuated by cam lobes formed on a surrounding cam ring. An example of such an apparatus is described in EP-A-0643221.

The valve means 12 comprises a body 16 which conveniently is formed in a housing for the distributor member 14. Extending within the body 16 is an open ended stepped bore 17 and opening into the bore is a first passage 18 which is connected to the accumulator chamber 10, a second passage 19 which is connected to a drain indicated by the arrow 20 and a third passage 21 which is connected to the distributor member 14. The passages 18 and 19 are spaced axially relative to each other and the passage 21 is disposed intermediate the passages 18 and 19.

The passage 21 opens into a reduced diameter portion 22 of the bore and the step which is defined between the reduced diameter portion 22 and the main portion of the bore 17 is machined to define a first seating 23 which is of frusto-conical form and tapers inwardly towards the portion 22 of the bore. In addition the passage 18 opens into an annular enlargement of the bore adjacent the seating 23. Slidable in the bore is a valve member 24 and this is machined for engagement with the seating 23. The valve element is coupled to an armature of an electromagnetic actuator 25 and in the arrangement shown when the actuator is supplied with electric current the valve member is drawn towards the left as seen in the drawing and is lifted from the seating 23.

The passage 19 opens into an enlarged portion of the bore and a second seating 26 is defined between the enlarged portion of the bore and the reduced diameter portion 22. The seating is of frusto-conical form and tapers inwardly towards the portion 22 of the bore.

The valve also includes a valve element 27 which is of hollow cylindrical form and has an inwardly extending flange 28 at its inner end. The valve element is slidable in the enlarged portion of the bore. The flange 28 is machined for sealing engagement with the seating 26 and the inner surface of the skirt portion of the valve element is slidably mounted upon an annular sleeve 29 which is located about a reduced portion of the valve member 24. Located between the flange 28 and one end of the sleeve 29 is a coiled compression spring 30 and the other end of the sleeve is of part spherical form for engagement with a complementary surface on a seal member 31 which engages an end cap 32 secured to the valve member. A further coiled compression spring 33 is interposed between the end cap 32 and the body 16.

The spring 33 biases the valve member 24 into engagement with the seating 23 and the spring 30 biases the valve element 27 into engagement with a stop surface 34 which is defined on the valve member. When the valve member is in engagement with the seating 23 a small clearance exists between the flange 28 of the valve element and the seating 26 so that the passage 19 is in communication with the passage 21 and the passages within the distributor member will be in communication with the drain 20. When it is required to supply fuel to a selected one of the outlets 13, the electromagnetic actuator 25 is energised to move the valve member towards the left as shown in the drawing against the action of the spring 33. During this movement the valve member 24 is lifted from the seating 23 so as to connect the passage 18 with the passage 21. During the initial movement of the valve member there will be a flow of fuel from the passage 18 to the passage 19 and in addition the gap between the seating 23 and the valve member will be small so that the rate of fuel supply to the selected outlet 13 will be low. During this period therefore the flow of fuel to the associated engine will be at a reduced rate. As the movement of the valve member continues the valve element will move into engagement with the seating 26 so that the escape of fuel to the drain is prevented and the gap between the valve member and the seating 23 will be increased so that fuel will be supplied at high rate along the passage 21. Further movement of the valve member takes place against the action of both springs and the final movement of the valve member is determined by the abutment of the end cap 32 with the end of the valve element 27. The flange 28 of the valve element is moved away from the stop surface 34.

The electromagnetic actuator 25 remains energised for so long as it is required to supply fuel to the associated engine and when the electromagnetic actuator is de-energised the valve member 24 is initially moved by the action of both springs 30 and 33 towards the seating 23 thereby ensuring rapid movement of the valve member. The spring 30 is only effective to move the valve member 24 into engagement with the seating 23 so long as there is clearance between the flange 28 and the stop surface 34. When this clearance is taken up further movement of the valve member is under the action of the spring 33 alone. During this portion of the movement the valve member engages the seating 23 to prevent the further supply of fuel from the accumulator chamber and in addition the valve element 27 is lifted quickly away from the seating 26 to place the passages 21 and 19 in communication with each other. The result is a rapid reduction of the pressure in the passage 21 and the high pressure in the passage 21 acts on the valve element 27 to lift the element further away from the seating 26 against the action of the spring 30. When the pressure in the passage 21 approaches the drain pressure, the valve element under the action of the spring 30 moves back into engagement with the stop surface 34. This movement reduces the effective flow area between the seating 26 and the flange 28 and the reduced flow area will act to damp pressure pulses which may appear in the passage 21 due to closure of the valve member within the injection nozzle 15.

The seat area of the valve member and the valve element may be equal but this would result in the valve member and valve element being pressure balanced during fuel supply to the engine. However, in order to increase the rate at which fuel can return from the passage 21, the seat area of the valve element 27 is made slightly larger than that of the valve member 24 so that pressure balance is not achieved and the sealing force applied to the valve element is slightly reduced.

I claim:

1. A fuel supply system for an engine comprising a fuel injection nozzle including a valve member movable to an open position to allow fuel flow through an outlet from a nozzle inlet, an accumulator chamber for storing fuel under pressure, valve means operable to connect the nozzle inlet to the accumulator chamber when it is required to supply fuel to the engine and to disconnect the nozzle inlet from the accumulator chamber and to connect it to a drain when sufficient fuel has been supplied to the engine, said valve means being a three way valve comprising a bore, first and second passages opening into the bore at axially spaced positions, said first passage being connected to the accumulator chamber and the second passage to the drain, a third passage connected to the nozzle inlet and opening into the bore, a first seating defined in the bore, an axially movable valve member slidable in the bore and shaped for cooperation with the first seating to control fuel flow between the first and third passages, means for moving the valve member into and out of sealing engagement with the first seating, a valve element movable into and out of sealing engagement with a second seating to control communication between the second and third passages, resilient means interconnecting the valve member and valve element whereby when the valve member is in engagement with the first seating the valve element will be spaced from the second seating, the fuel pressure in said third passage acting on said valve element in opposition to said resilient means to increase said spacing to facilitate fuel flow between said third passage and the second passage.

2. A fuel supply system for an engine, the system comprising a fuel injection nozzle including a valve member movable to an open position to allow fuel flow through an outlet from a nozzle inlet, an accumulator chamber for storing fuel under pressure, valve means operable to connect the nozzle inlet to the accumulator chamber when it is required to supply fuel to the engine and to disconnect the nozzle inlet from the accumulator chamber and to connect it to a drain when sufficient fuel has been supplied to the engine, said valve means comprising a valve member slidable within a bore, first and second passages opening into the bore at axially spaced positions, said first and second passages being connected to the accumulator chamber and the drain respectively, a third passage opening into the bore at a position intermediate said first and second passages, said third passage being connected to the nozzle inlet, a first seating defined in the bore intermediate the first and third passages, a second seating defined in the bore intermediate the second and third passages, the valve member being shaped for engagement with the first seating, a valve element slidably mounted about the valve member and being engageable with the second seating, means biasing said valve element into engagement with a stop surface defined on the valve member whereby when said valve member is in engagement with the first seating there will be a clearance between the valve element and the second seating and means for moving the valve member axially.

3. A system according to claim 2, including a stop operable to limit the movement of the valve member away from the first seating.

4. A system according to claim 3, in which said stop comprises an end cap carried by the valve member and positioned to engage the valve element to limit the movement of the valve member, the engagement of the end cap with the valve element acting to maintain the valve element in firm engagement with the second seating.

5. A system according to claim 4, including a spring interposed between the end cap and a body in which the bore is defined, said spring acting to urge the valve member into engagement with the first seating.

6. A system according to claim 2, in which the means biasing the valve element into engagement with the stop surface is a coiled compression spring which can yield to allow the valve element to move further away from the second seating under the action of fuel pressure in the third passage when the valve member is moved into engagement with the first seating, the valve element returning into engagement with the stop surface when the fuel pressure in the second passage is reduced.

7. A system according to claim 6, in which the seat diameter of the second seating is larger than that of the first seating.

8. A system according to claim 7, in which that said valve element is of annular form and has an inwardly directed flange which is shaped for co-operation with the second seating, said spring acting intermediate the flange and a sleeve mounted about the valve member.

* * * * *